US006676448B2

(12) United States Patent
Kato et al.

(10) Patent No.: US 6,676,448 B2
(45) Date of Patent: Jan. 13, 2004

(54) CONNECTOR

(75) Inventors: Tetsuo Kato, Shizuoka-ken (JP); Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/989,195

(22) Filed: Nov. 21, 2001

(65) Prior Publication Data

US 2002/0064993 A1 May 30, 2002

(30) Foreign Application Priority Data

Nov. 24, 2000 (JP) ..... 2000-357976
Nov. 2, 2001 (JP) ..... 2001-337329

(51) Int. Cl.[7] ..... H01R 13/40
(52) U.S. Cl. ..... 439/595; 439/752
(58) Field of Search ..... 439/595, 752, 439/733.1

(56) References Cited

U.S. PATENT DOCUMENTS 5,820,411 A * 10/1998 Okabe ..... 439/595

FOREIGN PATENT DOCUMENTS

JP 61-218081 9/1986

* cited by examiner

*Primary Examiner*—Alexander Gilman
(74) *Attorney, Agent, or Firm*—Finnegan, Henderson, Farabow, Garrett & Dunner, L.L.P.

(57) ABSTRACT

A connector of this invention has a plurality of openings at its rear wall for the insertion of terminals, terminal housing chambers communicating with these openings. Each terminal housing chamber has a pair of flexible arms supported by both the circumferential wall and the front wall of the connector housing, and an engagement member supported at both sides by the flexible arms. The terminal, upon insertion through the openings, engages with the engagement member, being prevented from being pulled out. The terminal housing chambers communicate with connection holes provided at the front wall of the connector. Mating terminals are inserted through the connection holes to be connected to the terminals.

11 Claims, 9 Drawing Sheets

CONNECTOR

BACKGROUND OF THE INVENTION

1. Field of the Invention

This invention relates to a connector having an engaging structure which allows a terminal to be securely engaged upon insertion from the rear of the connector.

2. Description of the Related Art

Japanese Patent Laid-Open Publication No. SHO-61-218081 discloses a connector which allows engagement with a terminal having a contact at the distal end to be completed upon the insertion of the terminal from the rear of the connector.

The conventional connector disclosed in the above publication has, as shown in FIGS. 1 and 2, a flexible engagement arm in a cantilever shape provided in a cavity for housing a terminal. A terminal connected to a wire is inserted from the rear of the cavity and a step provided to the terminal engages with the distal end of the flexible engagement arm. Thus upon the insertion of the terminal from the rear of the connector, the terminal is prevented from being pulled out.

SUMMARY OF THE INVENTION

The flexible engagement arm of the above conventional connector is a cantilever which is under force from the front. If tension is applied to the wire, the arm is likely to buckle as shown in FIG. 2. Thus if the wire is pulled with a strong force, it is likely that the flexible engagement arm will buckle and break, or the terminal will be pulled out.

This invention was made to solve the above problem, and has an object of providing a connector which enables more secure retention of a terminal by a flexible engagement arm.

A connector housing of a connector according to a first aspect of this invention comprises a plurality of openings provided to a rear wall of the connector, for inserting terminals therethrough, a plurality of terminal housing chambers communicating with the respective openings. Each terminal housing chamber has a pair of flexible arms supported by both a circumferential wall and a front wall of the connector housing, and an engagement member supported at both sides by the arms. The terminal housing chambers communicate with connection holes provided to the front wall of the connector housing. Mating terminals are inserted through the connection holes to be connected to the terminals.

The terminal inserted through the opening pushes up the engagement member, and an engaging part of the terminal engages with the engagement member. The pair of flexible arms is bendable with sufficient resiliency, to allow the pushing up movement of the engaging part for engagement with the engagement member.

The pair of flexible arms is supported not only at the circumferential wall of the connector housing but also at the front wall of the connector housing, thereby being unlikely to buckle even when the terminal is subjected to tension. Further, since the engagement member is supported by the left and right flexible arms, the engaging part is unlikely to disengage from the engagement member even if the terminal is twisted or pulled, resulting in secure engagement.

According to a second aspect of this invention, the connector housing of the present connector further comprises a terminal upper portion housing space provided between the flexible arms and positioned forward of the engagement member, extending to the front wall for holding an upper portion of a main body of the terminal. The terminal upper portion housing space is in a longitudinally elongating rectangular shape, holding the upper portion of terminal main body. Since the pair of flexible arms retains the upper portion of the terminal main body from both sides, the rotational or lateral movement of the terminal is prevented. Further, since the terminal upper portion housing space extends in a longitudinal direction, the contact can also be configured to elongate in a longitudinal direction, thereby being more securely retained. Thus the connection between the contact and a mating terminal is secured, preventing the disengagement of the engaging part from the engagement member, resulting in more reliable engagement.

According to a third aspect of this invention, the connector housing of the present connector further comprises a ceiling member provided to the pair of flexible arms, facing to the circumferential wall of the connector housing, for covering the terminal upper portion housing space. The ceiling member prevents vertical movement of the upper portion of the terminal main body. Thus the connection between the contact and a mating terminal is secured, preventing the disengagement of the engaging part from the engagement member, resulting in more reliable engagement.

DETAILED DESCRIPTION OF THE PREFERRED EMBODIMENTS

A first embodiment of this invention will be described hereinafter with reference to FIGS. 1 to 8.

Figure 1:
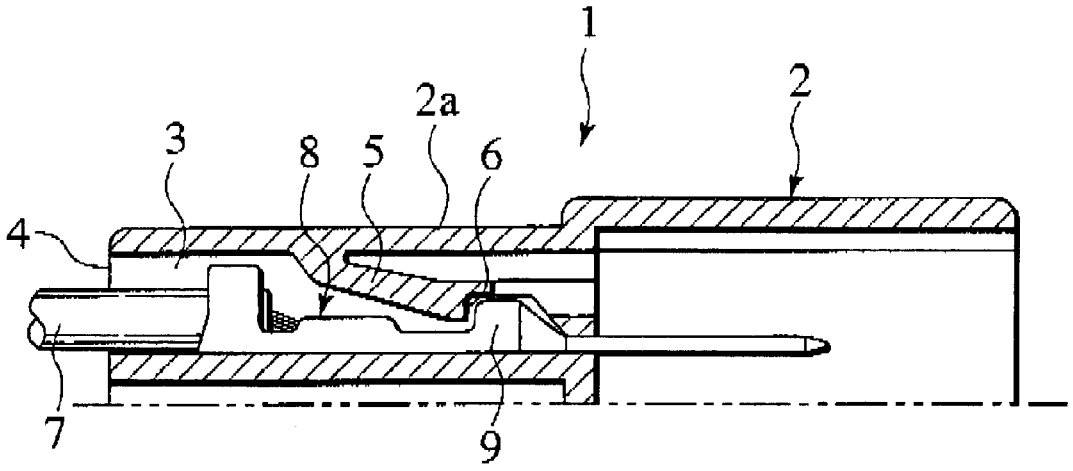
FIG.1 PRIOR ART
FIG. 1 is a longitudinal sectional view of an essential portion of a prior art connector.
Figure 2:
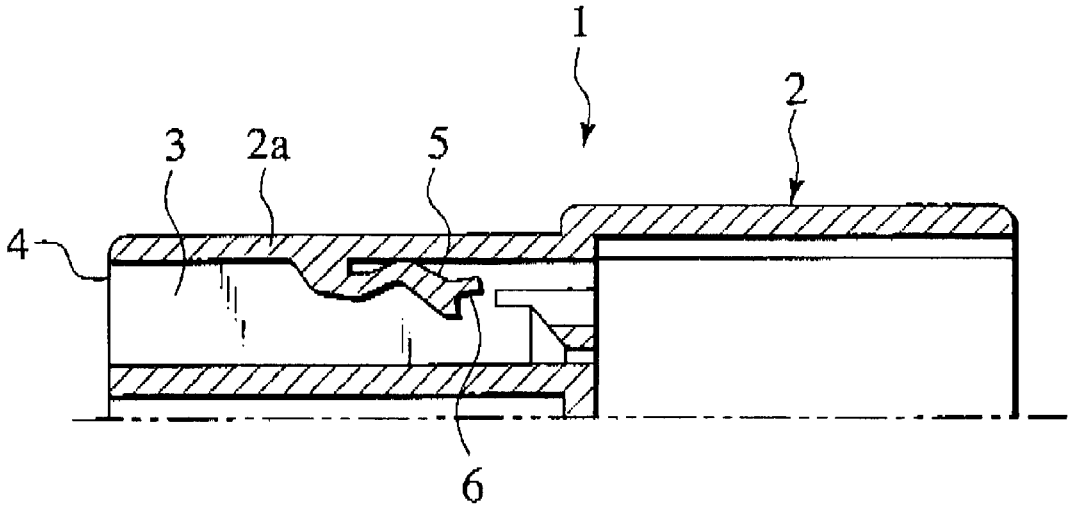
FIG.2 PRIOR ART
FIG. 2 shows a state where a flexible arm of the prior art connector buckles.
Figure 3:
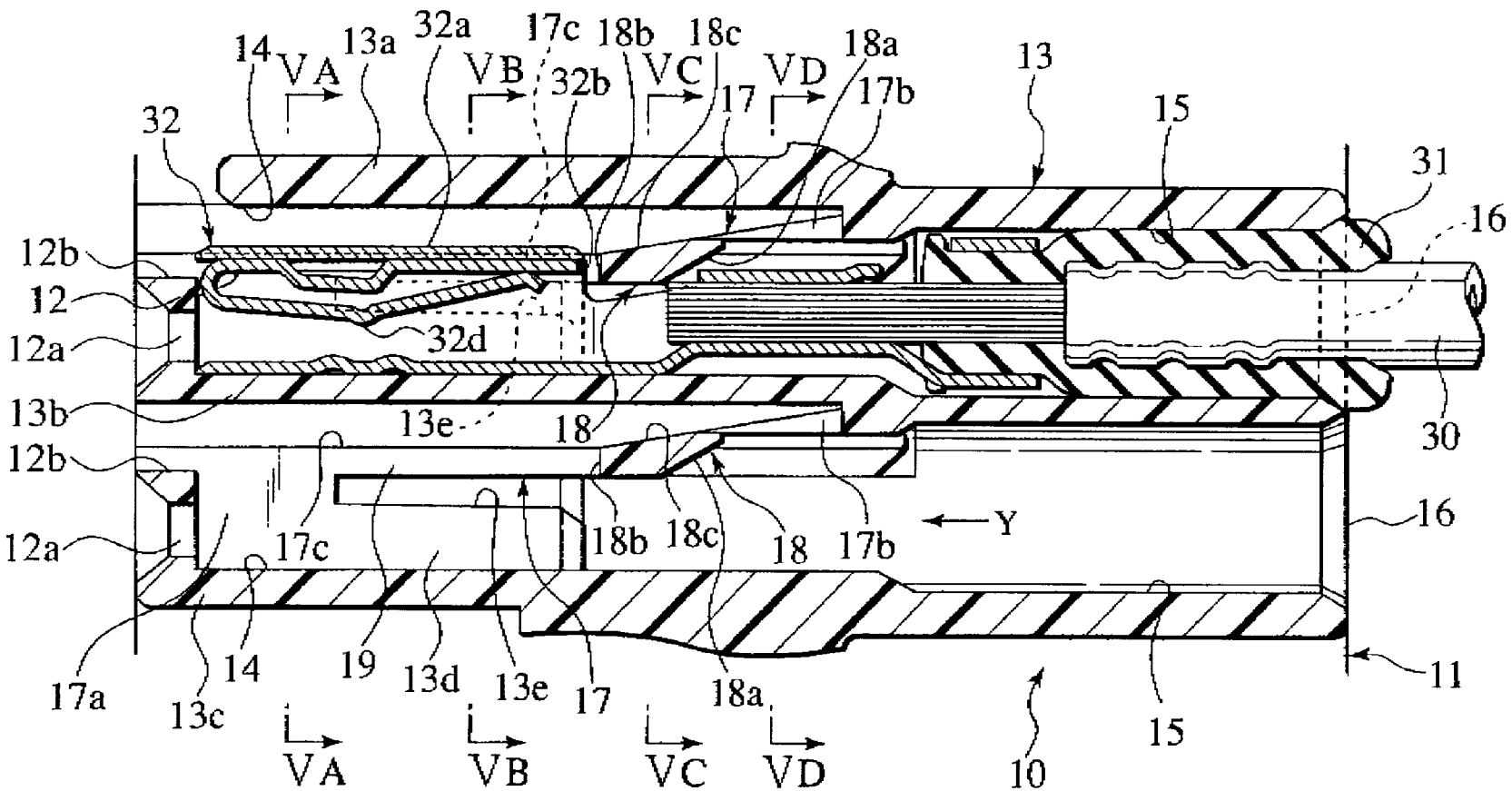
FIG. 3 is a longitudinal sectional view of an essential portion of a connector according to a first embodiment of this inventions.
Figure 4:
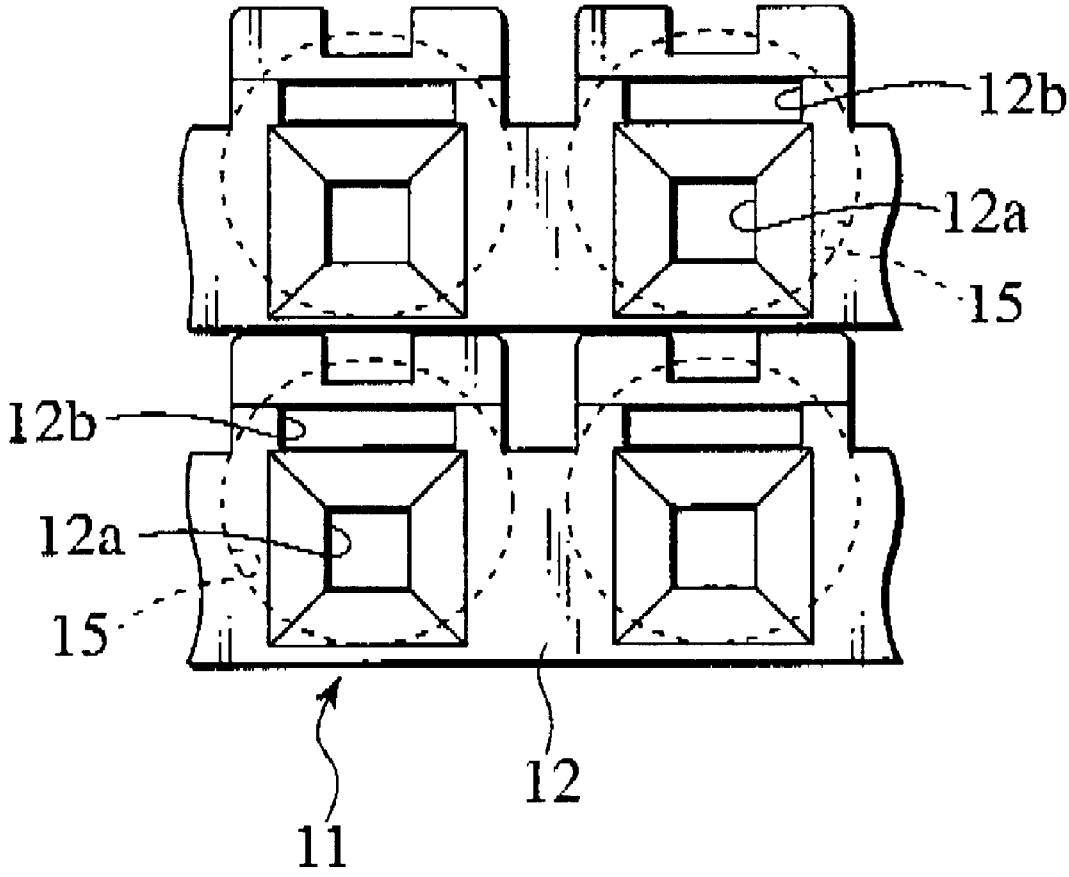
FIG. 4 is a front view of an essential portion of the connector according to the first embodiment of this invention.

A connector housing 11 of a connector 10 according to a first embodiment of this invention is made from resin, having a plurality of terminal housing chambers 14 partitioned by a partitioning wall 13*b* as shown in FIG. 3 and packing housing chambers 15 communicating with the terminal housing chambers 14. The terminal housing chambers 14 and the packing housing chambers 15 are also laterally arranged in rows as shown in FIG. 4. The terminal housing chambers 14 are in a quadrangular prism shape, having a substantially square section. The packing housing chambers 15 are in a substantially cylinder shape. The terminal chambers 14 and the packing chambers 15 communicate with one another, respectively.

The right-hand side of FIG. 3 shows the openings of each packing chamber 15 at a rear wall of the connector housing 11, serving as openings 16 for inserting terminals therethrough. A wire 30 with a terminal 32 crimped onto its distal end is inserted, together with a packing 31, through the terminal insertion opening 16.

The left-hand side of FIG. 3 shows the openings of each terminal chamber 14 at a front wall 12 of the connector housing 11, serving as a connection hole 12*a* as shown in FIG. 4. The connection hole 12*a* is internally tapered to facilitate the insertion of a mating terminal.

The partitioning wall 13*b* partitioning the terminal chambers 14 defines the bottom surface of a circumferential wall 13 of the upper terminal chamber 14 as well as the top surface of the circumferential wall 13 of the lower terminal chamber 14. The top surface of the upper terminal chamber 14 is a top wall 13*a*, and the bottom surface of the lower terminal chamber 14 is a bottom wall 13*c*. The each circumferential wall 13 thus consists of the partitioning wall 13*b*, the top wall 13*a* or the bottom wall 13*c*, and a side wall 13*d*. The front wall 12 has, above the connection hole 12*a*, front openings 12*b* for receiving a front holder 20.

A pair of flexible arms 17 extends from a boundary portion in the top surface of the circumferential wall 13 between the terminal chamber 14 and the packing chamber 15, over the connection hole 12*a* of the front wall 12. The pair of flexible arms 17 is integrally molded with the circumferential wall 13 and the front wall 12, having a fixed-both-ends beam structure.

The flexible arms 17 are provided with an engagement member 18 extending therebetween. The engagement member 18 has a lower oblique surface 18*a*. The front portion of the engagement member 18, the left portion in FIG. 3, is an engagement surface 8*b*, substantially intersecting the terminal inserting direction Y. Two side walls 13*d* below the flexible arms 17 have slots 13*e* which allow the arms 17 to bend downwards. The engagement member 18, the lower oblique surface 18*a*, and the pair of flexible arms 17 are integrally molded, A terminal upper portion housing space 19 is formed between the flexible arms 17. In front of the engagement member 18, in a longitudinally elongating rectangular shape as shown in the left-hand portion of FIG. 3.

Figure 5A:
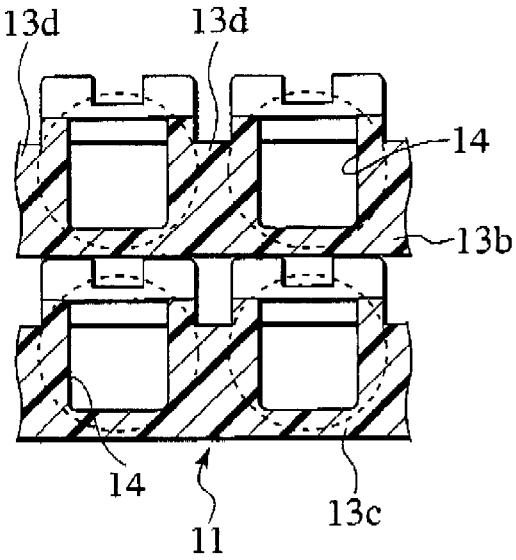
FIG. 5A is a sectional view of the connector according to the first embodiment of this invention, taken along line VA—VA of FIG. 3.
Figure 5B:
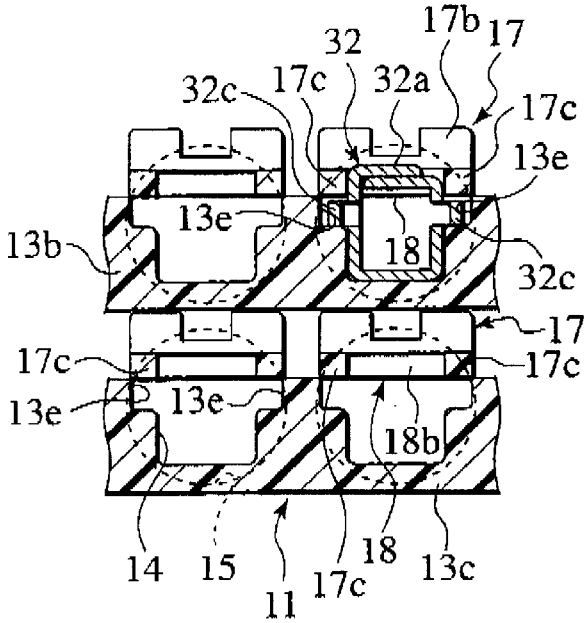
FIG. 5B is a sectional view of the connector according to the first embodiment of this invention, taken along line VB—VB of FIG. 3.
Figure 5C:
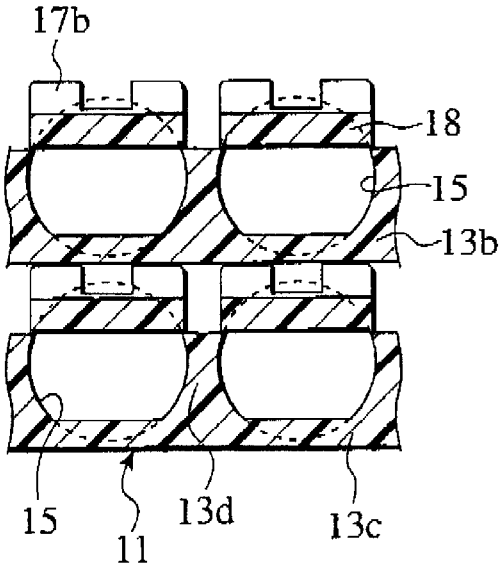
FIG. 5C is a sectional view of the connector according to the first embodiment of this invention, taken along line VC—VC of FIG. 3.
Figure 5D:
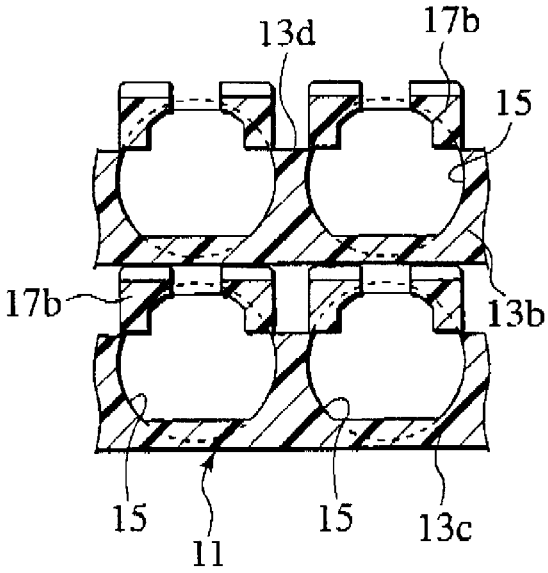
FIG. 5D is a sectional view of the connector according to the first embodiment of this invention, taken along line VD—VD of FIG. 3.
Figure 6:
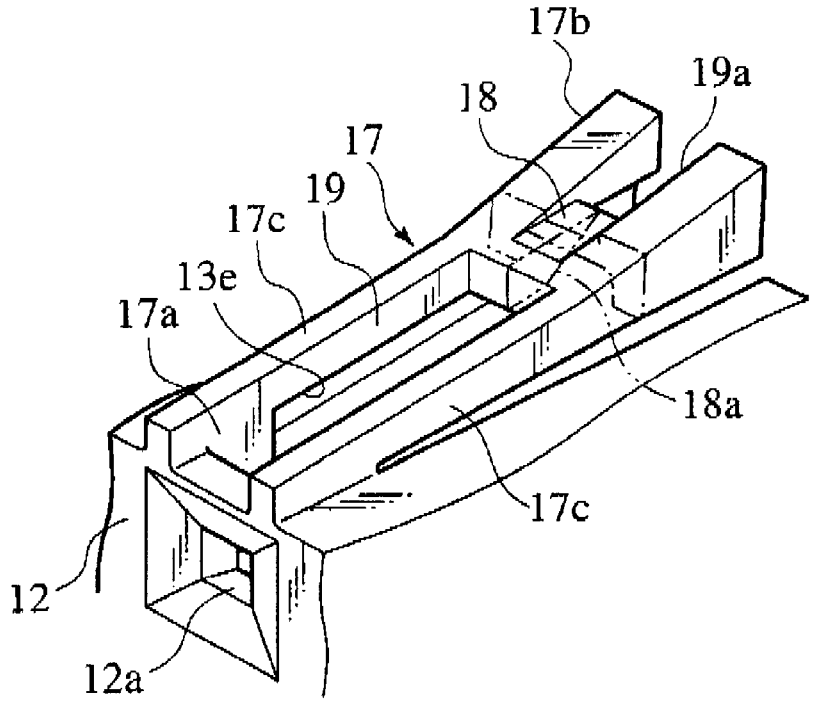
FIG. 6 is a perspective view of flexible arms and the surroundings of the connector according to the first embodiment of this invention.
Figure 7:
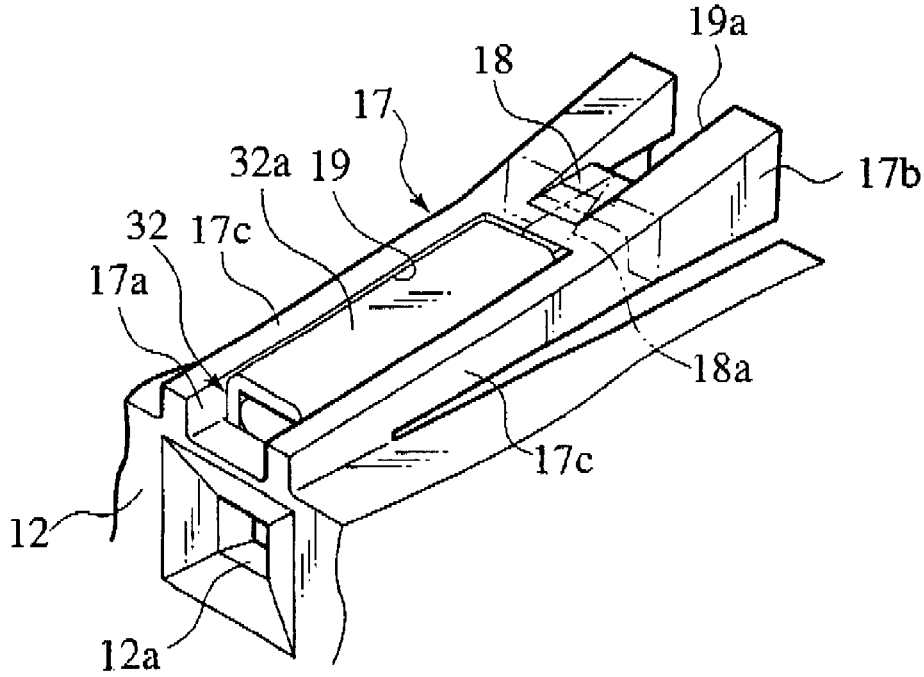
FIG. 7 is a perspective view of the flexible arms engaging with a terminal.

The terminal 32 provided with an engaging part 32*b* described later is inserted into the terminal chamber 14, the engaging part 32*b* pushing the engagement member 18 upwards to engage. The lower oblique surface 18*a* guides the engaging part 32*b* in pushing up the engagement member 18. The pair of flexible arms 17 has sufficient resiliency and can flex in a vertical direction to allow the above engagement. Upon engagement, the upper portion of a box-shape main body 32*a* of the terminal 32, which is arranged forward of the engaging part 32*b*, is held in the terminal upper portion housing space 19. As shown in FIG. 5B, the slots 13*e* in both sides of the terminal chamber 14 guide protruding parts 32*c* of the main body 32*a* arranged at both sides thereof.

Figure 8:
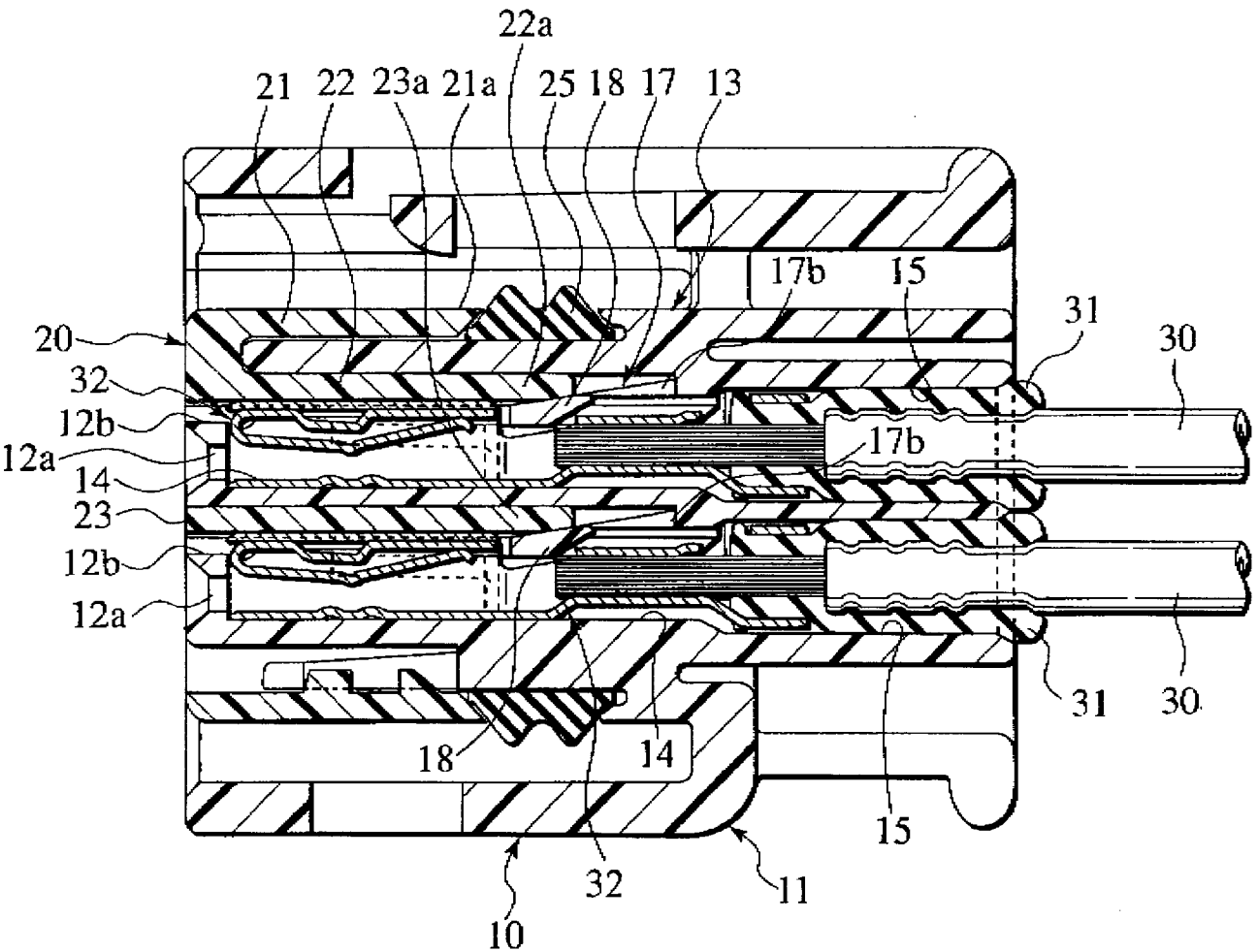
FIG. 8 is a longitudinal sectional view of the connector according to the first embodiment of this invention.

The front holder 20 to be fitted into the connector housing 11 has an outer peripheral wall 21, a plurality of upper inner peripheral walls 22, and a plurality of lower inner peripheral walls 23. The outer wall 21 engages with the circumferential wall 13 of the connector housing 11, and the inner peripheral walls 22, 23 engage with the front openings 12*b*, respectively. A distal end 21*a* of the outer wall 21 has an internally tapered inner surface. As shown in FIG. 8, when the front holder 20 is fitted into the connector housing 11, a ring-shaped waterproof packing 25 is brought into close contact with the outer peripheral surface of the circumferential wall 13 of the connector housing 11, to be retained. The inner walls 22, 23 abut on the top surface of the respective flexible arms 17 to press them down, thereby preventing the disengagement of the engagement members 18 from the engaging parts 32*b*.

The connector 10 according to the first embodiment of this invention as described above has the pair of flexible arms 17 in a fixed-both-ends beam structure and the engagement member 18, thereby preventing the breakage or disengagement of the flexible arms 17 even when excessive force is applied to the wire 30 in engagement. The flexible arms 17 retain an upper portion of the box-shape main body 32*a* of the terminal 32 at both sides, so that the terminal 32 is securely held even if a twisting or pulling force is applied to the terminal 32. The front holder 20 fixes the flexible arms 17, thereby further preventing disengagement. Thus reliability in connection between the terminal 32 and a mating terminal not shown is obtained.

Figure 9:
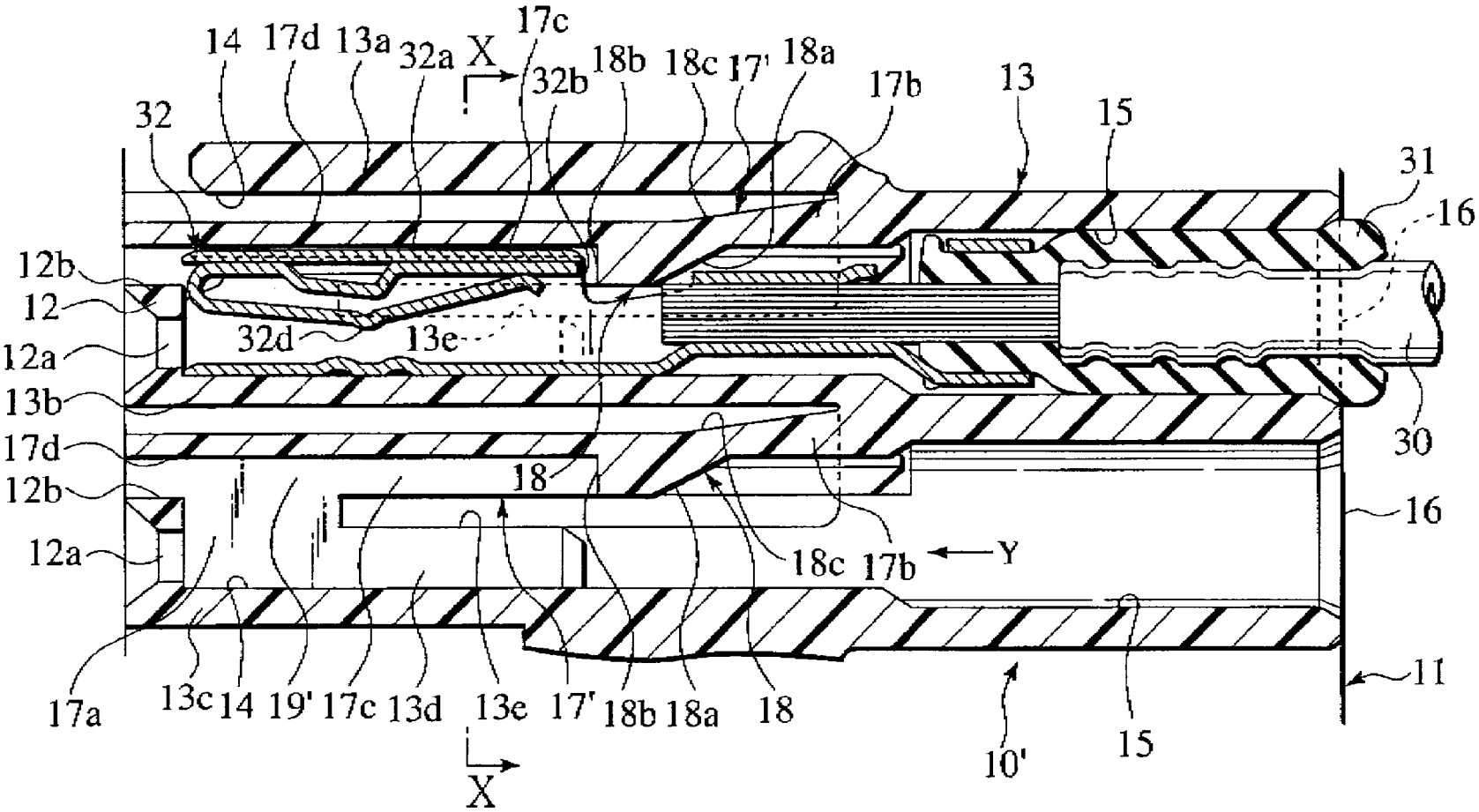
FIG. 9 is a longitudinal sectional view of an essential portion of a connector according to a second embodiment of this invention.
Figure 10:
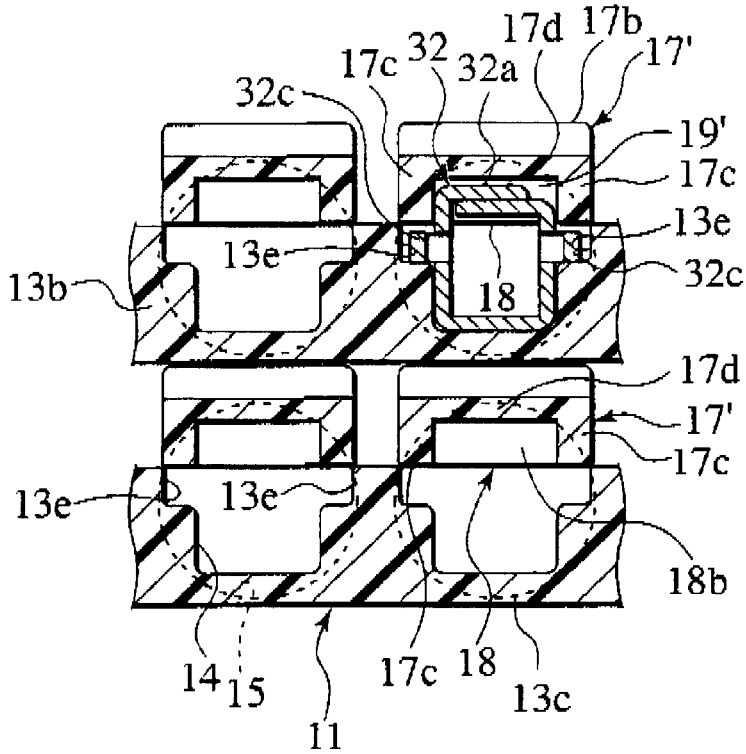
FIG. 10 is a sectional view of the connector according to the second embodiment of this invention, taken along line X—X of FIG. 9.

Now, with reference to FIGS. 9 and 10, a second embodiment of this invention will be described. In FIGS. 9 and 10, like members as in the first embodiment are referred with like reference numerals to omit detailed description thereof.

A connector housing 11' according to the second embodiment of this invention has a ceiling member 17*d* covering a terminal upper portion housing space 19'. The ceiling member 17*d* is integrally molded with a pair of flexible arms 17', covering the terminal upper portion housing space 19', opposite to the circumferential wall 13. The terminal upper portion housing space 19' houses an upper portion of a box-shape main body 32*a* of a terminal 32. The surface of the ceiling member 17*d* opposite to the terminal upper portion housing space 19' is configured to come into close contact with the upper portion of the terminal main body 32*a*.

The connector 10' according to the second embodiment of this invention as described above has effects of restricting movement of the terminal 32 by the close contact between the ceiling member 17*d* and the upper portion of the terminal main body 32*a* in addition to the effects brought by the connector 10 according to the first embodiment. When a front holder 20 is fitted into a housing 11, distal ends 22*a*,

23*a* of inner peripheral walls 22, 23 of the front holder 20 fix the flexible arms 17', restricting the movement of the ceiling members 17*d*, resulting in the reliable restriction of the movement of the terminal 32. Thus reliability in connection between the terminal 32 and a mating terminal not shown is secured.

Figure 12:
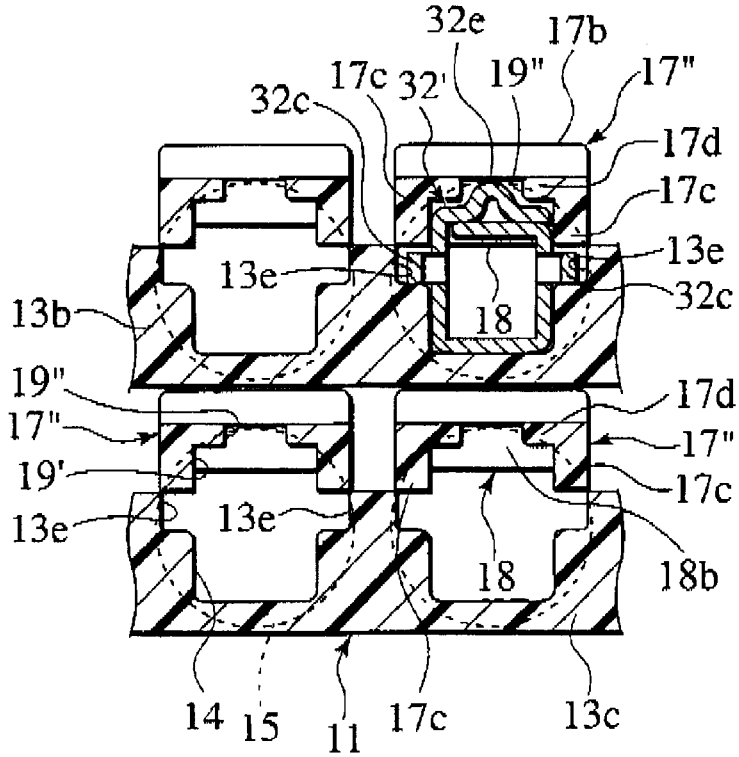
FIG. 12 is a sectional view of the connector according to the third embodiment of this invention, taken long line XII—XII of FIG. 11.
Figure 11:
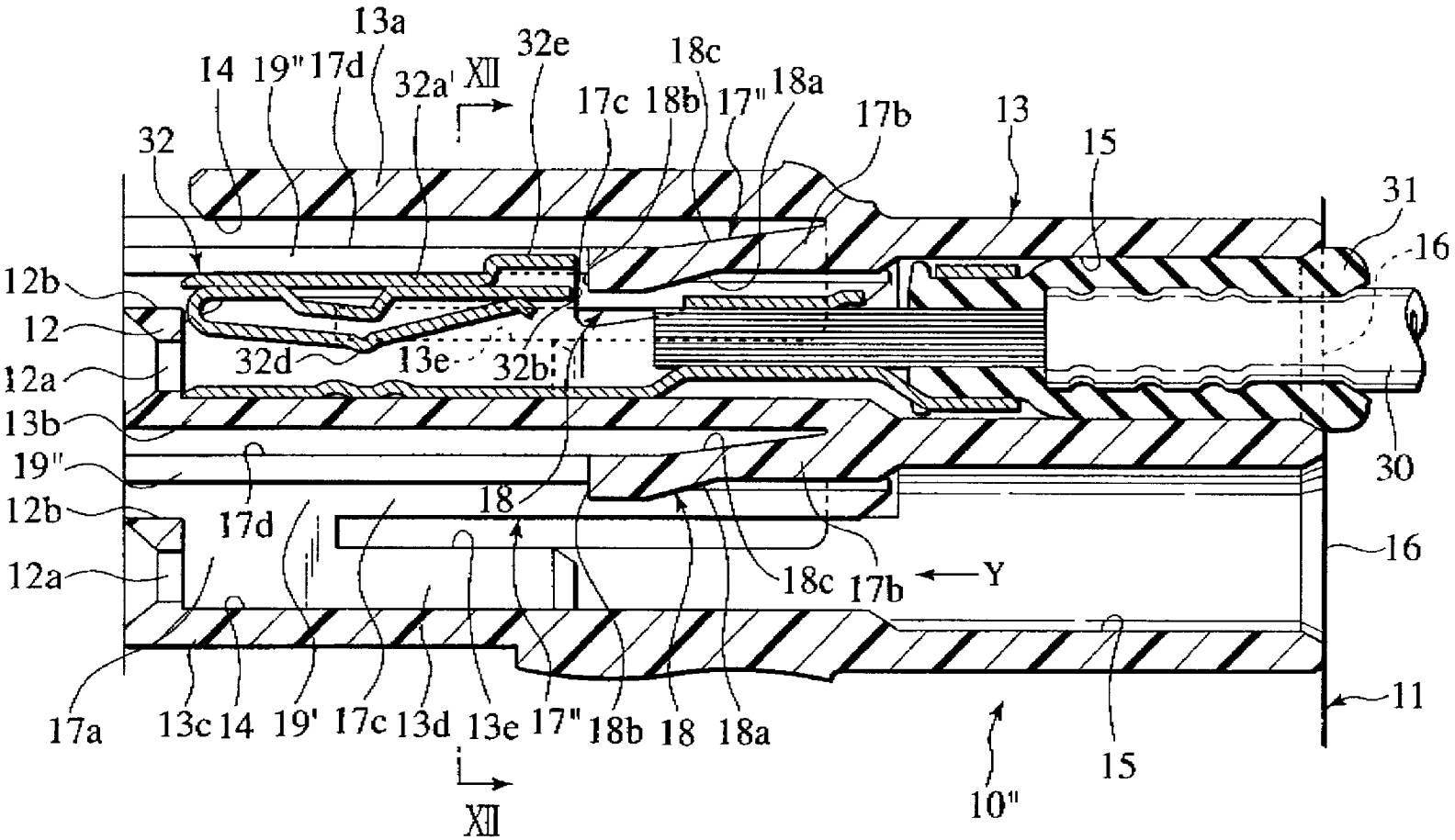
FIG. 11 is a longitudinal sectional view of an essential portion of a connector according to a third embodiment of this invention.

Next, with reference to FIGS. 11 and 12, a third embodiment of this invention will be described. In FIGS. 11 and 12, like members as in the first and second embodiments are given like reference numerals to omit detailed description thereof.

A connector 10" according to the third embodiment of this invention has a longitudinally elongating rectangular slit 19" in the laterally middle portion of a ceiling member 17*d* covering a terminal upper portion housing space 19'. The ceiling member 17*d* is integrally molded with a pair of flexible arms 17", covering the terminal upper portion housing space 19', facing to the circumferential wall 13. The terminal upper portion housing space 19' houses an upper portion of a box-shape main body 32*a'* of a terminal 32'. The upper portion of the terminal main body 32*a'* has a protruding part 32*e* on the upper surface thereof in the laterally middle portion. The slit 19" of the ceiling member 17*d* retains the upper protruding part 32*e* of the terminal main body 32*a'*.

The connector 10" according to the third embodiment of this invention as described above has effects of restricting movement of the terminal 32' by the slit 19" holding the protruding part 32*e*, in addition to the effects brought by the connector 10' according to the second embodiment. When a front holder 20 is fitted into a connector housing 11, distal ends 22*a*, 23*a* of inner peripheral walls 22, 23 of the front holder 20 fix the flexible arm 17", restricting movement of the ceiling member 17*d*, resulting in reliable restriction of movement of the terminal 32'. Thus reliability in connection between the terminal 32' and a mating terminal not shown is secured.

The preferred embodiments of this invention have been described, which are not intended to limit this invention to the above embodiments. The above disclosure enables those of skill in the art to perform this invention through modification or variation of the embodiments. For example, the connector of the above embodiments has vertically two terminal housing chambers, it may also have three chambers vertically. Further, this invention may be applied to a mating connector in the above embodiments.

What is claimed is:

1. A connector, comprising:

a plurality of openings provided at a rear wall of the connector housing, for inserting terminals therethrough;

a plurality of terminal housing chambers communicating with the respective openings;

a pair of flexible arms respectively linking a circumferential wall of each terminal housing chamber and a front wall of the connector housing; and an engagement member supported at both sides by the flexible arms, wherein the flexible arms elastically deform so as to allow the engagement member to engage with an engaging part of the terminal.

2. A connector as set forth in claim 1, further comprising:

a terminal upper portion housing space provided between the flexible arms and positioned forward of the engagement member, extending to the front wall, for holding an upper portion of a terminal main body.

3. A connector as set forth in claim 2, wherein:

the terminal upper portion housing space is in a longitudinally elongating rectangular shape.

4. A connector as set forth in claim 2, wherein:

the pair of flexible arms has a ceiling member integral therewith facing to the circumferential wall of the connector housing, for covering the terminal upper portion housing space.

5. A connector as set forth in claim 4, wherein:

the ceiling member has a longitudinally elongating rectangular slit for housing an upper protruding part of the upper portion of the terminal main body.

6. A connector, comprising:

a plurality of openings provided at a rear wall of the connector housing, for inserting terminals therethrough;

a plurality of terminal housing chambers communicating with the respective openings;

a pair of flexible arms extending from a circumferential wall of each terminal housing chamber to a front wall of the connector housing;

an engagement member supported at both sides by the flexible arms, wherein the flexible arms elastically deform so as to allow the engagement member to engage with an engaging part of the terminal; and a terminal upper portion housing space provided between the flexible arms and positioned forward of the engagement member, extending to the front wall, for holding an upper portion of a terminal main body.

7. A connector as set forth in claim 6, wherein the terminal upper portion housing space is in a longitudinally elongating rectangular shape.

8. A connector as set forth in claim 6, wherein the pair of flexible arms has a ceiling member integral therewith facing to the circumferential wall of the connector housing, for covering the terminal upper portion housing space.

9. A connector as set forth in claim 8, wherein the ceiling member has a longitudinally elongating rectangular slit for housing an upper protruding part of the upper portion of the terminal main body.

10. A connector, comprising:

a plurality of openings provided at a rear wall of the connector housing, for inserting terminals therethrough;

a plurality of terminal housing chambers communicating with the respective openings;

a flexible arm respectively linking a circumferential wall of each terminal housing chamber and a front wall of the connector housing, the flexible arm being forked into two fork arms at a portion positioned forward of the front wall and integrally connected with the front wall of the connector housing; and an engagement member provided between the two fork arms, the engagement member being supported at both sides by the two fork arms, wherein each of the two fork arms is adapted to elastically deform so as to allow the engagement member to engage with an engaging part of the terminal.

11. A connector as set forth in claim 10, wherein each of the two fork arms has a ceiling member integral therewith facing the circumferential wall of the connector housing, the ceiling member being adapted to cover the terminal upper portion housing space.

* * * * *